United States Patent [19]

Smith, II

[11] 3,956,560

[45] May 11, 1976

[54] SMOOTH SURFACED TEXTILE FABRIC

[75] Inventor: Alexander M. Smith, II, Elkin, N.C.

[73] Assignee: The Fiberwoven Corporation, Elkin, N.C.

[22] Filed: June 5, 1974

[21] Appl. No.: 476,565

Related U.S. Application Data

[63] Continuation-in-part of Ser. No. 221,614, Jan. 28, 1972, Pat. No. 3,817,820.

[52] U.S. Cl. ..... 428/218; 28/72.2 R; 428/151; 428/284; 428/286; 428/287; 428/300; 428/301; 428/904

[51] Int. Cl.[2] ..... B32B 5/06

[58] Field of Search ..... 161/80, 154, 155, 166, 161/DIG. 2; 28/72.2 R, 72 CS, 72 NW, 75 R, 75 WT; 117/28, 111 F; 118/123; 428/151, 234, 235, 284, 286, 287, 300, 301, 904, 218

[56] References Cited

UNITED STATES PATENTS 3,607,481 9/1971 Shinohara ..... 161/DIG. 2

3,817,820 6/1974 Smith ..... 161/154

*Primary Examiner*—Marion E. McCamish
*Attorney, Agent, or Firm*—Cushman, Darby & Cushman

[57] ABSTRACT

A smooth-surfaced textile fabric, suitable for use in artificial leather, is prepared by needling staple fibers into a coherently-entangled structure. The structure has a base layer which carries a major portion of planar loading and a top layer which carries a minor portion of planar loading. Disposed on the top layer is a polymeric finish having a smooth surface. The base layer and the top layer are connected by connecting fibers having segments disposed in each of the said layers and the connecting fibers only loosely connect the top layer to the base layer.

39 Claims, 4 Drawing Figures

BEFORE STRETCHING AFTER STRETCHING

PRIOR ART FABRIC

BEFORE STRETCHING AFTER STRETCHING

PRESENT FABRIC

SMOOTH SURFACED TEXTILE FABRIC

This is a continuation-in-part of copending application Ser. No. 221,614, entitled NEEDLED TEXTILE FABRIC and filed on Jan. 28, 1972 and now U.S. Pat. No. 3,817,820.

The present invention relates to a smooth-surfaced artificial leather fabric and more particularly to such a fabric wherein the smooth surface is not substantially microundulated even when the fabric is placed under forces which stretch the fabric as much as 15% to 20% on an area basis.

BACKGROUND OF THE INVENTION

For certain applications, it is desired that artificial leather fabrics have a smooth surface, e.g., shoes having the appearance of calf-skin leather shoes. Artificial leather fabrics usually have a component comprised of fibers in some engaging association, e.g., woven, knitted, felted, needled, etc. This fibrous engagement limits, at least to some extent, certain physical properties of the fabric such as elongation, as opposed to an artificial leather made wholly of a polymeric film or film-like element.

Artificial leather fabrics have encountered some of the problems associated with tanned leathers, and this is not surprising, bearing in mind that leather is a fibrous material. One of these common problems is known as "orange peel." This problem is well known in the shoemaking arts and is of concern when leathers are lasted into shoes having a smooth surface. In the lasting process, leather is pulled over a shoe last to mold the leather to the three-dimensional surface of the last. This stretching often extends the leather by about 10% or slightly more on an area basis. For some particular styles of shoes and in some particular types of lasting operations, the leather may be extended, at least on a local basis, in excess of this percentage, i.e., about 15% or more. Fine calfskin leather can be stretched these amounts and still maintain a smooth surface after lasting. On the other hand, many other leathers, e.g., "split" leathers are incapable of maintaining a smooth surface with such area extensions and develop local non-planar areas on the surface. These non-planar areas are usually in the form of small depression, the size of which may be quite small in diameter, i.e., as little as 1/16th inch or less, or even a 32nd or 64th inch or less. Also, the depressions may extend into the surface of the leather a very small distance, e.g., a few thousandths of an inch or even less. Nevertheless, these depressions reflect light unevenly and produce an unsightly, undulated surface appearance. This is particularly true when light is reflected from a highly polished smooth leather surface. In some cases, the depressions can disfigure the surface of the leather in such a manner as to produce roughness which resembles the surface of an orange and the art describes those cases as "orange peel." The absence of "orange peel" is one of the indications of acceptable quality leather, or, alternately, the presence of "orange peel" indicates poor quality leather.

The mechanism responsible for these differences in leathers, e.g., between calfskin and "split" leathers, which allows or avoids "orange peel" is similar to fundamental mechanisms underlying the present invention. Thus, an understanding of "orange peel" in leathers elucidates important features of the present invention and is, therefore, explained below.

Animal skins which are tanned to produce leather are usually characterized as being composed of two layers, i.e., the epidermis and the dermis. The epidermis or surface is largely removed during the tanning process leaving the dermis which is in turn made up of two regions, commonly referred to as the papillary or grain layer and the reticular or corium layer. Both regions are composed of collagen fibers. The grain region is made up of short, fine, closely packed fiber bundles. The corium region is made up of longer, coarser and more loosely packed fiber bundles. In spite of its density, the grain layer is soft, particularly near the grain-corium junction. In this region the original animal skins contained fat cells, sweat glands, and hair follicles. Since these are removed in the course of converting the skins into leather, there remains a spongy or low modulus plane connecting the grain layer to the corium. This spongy region is very pronounced in leather made from the skin of certain animals, i.e., for example, sheep. While it is less pronounced in calfskin leather, it is nevertheless quite distinctly present. In the leather art, reference is made to the character of the bonding of the grain and reticular layers through this low modulus, spongy plane as "tight", "loose", or as having "many" or "few" bonding points.

The fiber network of the corium layer gives leather its strength and tough character. During stretching, the fiber bundles of this layer adjust to accept load and non-uniform, load-induced movement is inevitable in this layer. However, in calfskin leather the corium layer is relatively loosely connected through the low modulus, spongy layer to the grain layer and this loose connection tends to dissipate the load-induced, non-uniform movements and the surface of the grain layer remains smooth. On the other hand, in "split" leathers, this low modulus, spongy plane is removed during the "splitting" operation and these load-induced, irregular movements tend to transmit to the surface of the "split" leather. Under the effects of higher elongations, the irregular movements show up as "orange peel" in the "split" leathers. The same is true for other leathers where this low modulus, spongy plane, i.e., the loose connection, is either not naturally present or where it has been destroyed. Thus, "orange peel" is avoided in the leather arts simply by avoiding the use of such leathers, i.e., choosing high quality leathers, in lasting shoes in the manner described above. Unfortunately, in artificial leather fabrics, these problems cannot be so simply solved.

"Orange peel" has been a particularly difficult problem with artificial leather fabrics and the art has sought various solutions thereto. In one artificial leather, a tightly-woven high-count fabric was placed between a non-woven textile fabric base and a surface film. The intended function of this tightly-woven fabric was to control stretching of the artificial leather fabric during lasting into shoes and, hence, avoid local elongations which would induce "orange peel." Unfortunately, this tightly-woven base presented additional forming problems to the artificial leather, including elastic memory, and was not an acceptable arrangement. In aother artificial leather, a relatively thick foamed film was placed on the surface of a non-woven textile fabric so that irregular movements induced in the fibrous base during lasting of shoes were not fully transmitted through the thick foamed film to the surface thereof. While this approach does, indeed, eliminate most of the problem, it causes other problems, especially in that the soft film is easily scuffed, snagged or torn and does not produce a very durable product.

It will be appreciated from the foregoing that the undesired appearance of "orange peel" or surface roughness is a problem with all types of artificial leathers, but the problem is pronounced with smooth-surfaced artificial leathers. It is in this connection that the present invention has its major utility. In this regard, for purposes of the following disclosure and claims, the term "smooth surface artificial leather fabrics" refers to those artificial leather fabrics which have a visual appearance from a conversational distance similar to calfskin leathers, as opposed to heavily embossed leathers. However, even in heavily grained artifical leather fabrics, there may be areas between the heavy embossing where "orange peel" or surface roughness may constitute a problem. Therefore, the foregoing term is intended to include those grained artificial leather fabrics where "orange peel" or surface roughness constitute a problem.

OBJECTS OF THE INVENTION

It is, therefore, an object of the present invention to provide a smooth-surfaced artificial leather fabric wherein the fabric may be extended on an area basis to a substantial degree without significant surface roughness or "orange peel." It is a further object of the invention to provide a smooth-surfaced artificial leather fabric by novel processes. It is yet a further object of the invention to provide a smooth surfaced artificial leather fabric which may be used in a variety of applications where extension of the fabric is required without significant distortion of the surface of the fabric. Other objects will be apparent from the following disclosure and claims.

BRIEF DESCRIPTION OF THE INVENTION

Figure 1:
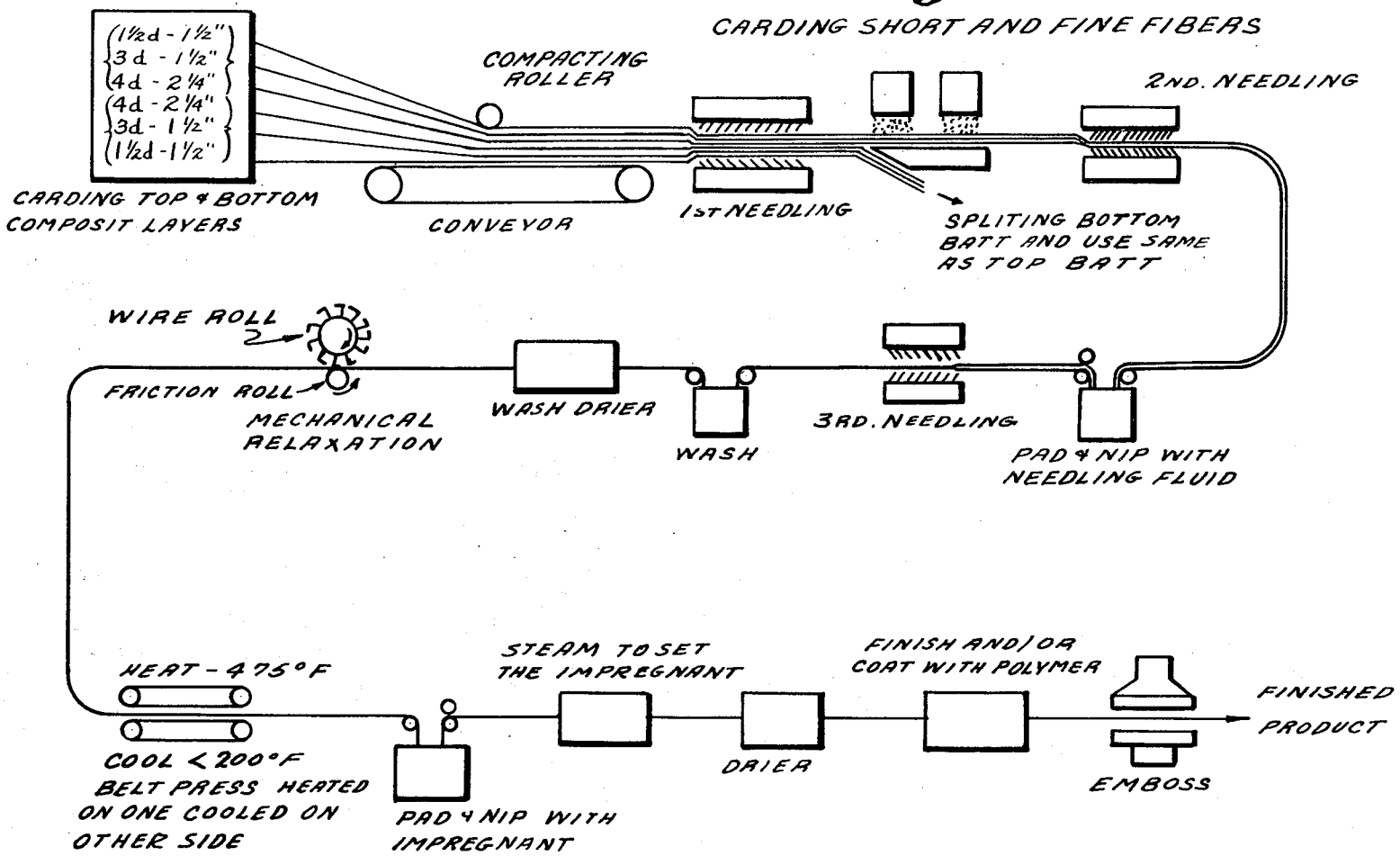
FIG. 1 is a schematic illustration of a total process for making an artificial leather fabric according to the parent application.

The invention provides an artificial leather fabric which comprises a needled structure of coherently entangled textile fibers. The needled structure has a back surface and a face surface and a polymeric finish having a smooth surface is disposed on the face surface of the structure. A base layer of the structure extends from the back surface toward the face surface and lies generally parallel to the back surface and the base layer is adapted to carry the major proportion of a planar loading induced in the artificial leather fabric. A top layer of the structure extends from the face surface toward the back surface and lies generally parallel to the face surface and the top layer is adapted to carry only a minor proportion of a planar loading. The base layer and the top layer are connected by connecting fibers which have segments disposed in each of the layers and the connecting fibers only loosely connect the top layer to the base layer.

The connecting fibers form a connecting region between the top layer and the base layer when the modulus of the connecting region is less than the modulus of either the top layer or the base layer. Also, the density of the connecting region may be less than the density of the base layer or the top layer. The lower modulus of the connecting region, at least in part, may result from the configuration of the connecting fibers in the connecting region or from the material composition of the connecting fibers in the connecting region or from the number of connecting fibers in the connecting region. The connecting fibers may be tightly anchored in both the top layer and base layer and the modulus (tensile and/or shear modulus) in the connecting region is less than the modulus in either the top layer or base layer. Also, the connecting fibers may be loosely anchored in both the top layer and base layer and the lower modulus may result from fiber slippage into the top and/or base layers.

The fabric is preferably constructed by needling top layer connecting fibers from the top layer into the base layer and base layer connecting fibers from the base layer into the top layer. Thus, the top layer is needled to the base layer such that the top layer is loosely connected to the base layer and the connecting fibers form a connecting region which has a modulus less than the modulus of either the top layer or the base layer.

According to one form of the process for producing the artificial leather fabric, a web of loosely-matted low pick-up factor textile fibers is formed. The web is first needled to produce a needled base layer having a dense outer top surface. Onto this dense outer top surface is laid a layer of high needle pick-up factor textile fibers. A second needling is performed to needle these high needle pick-up factor fibers on and into the said dense outer top surface. Needling is continued until a top layer of high needle pick-up factor fibers is formed and the top layer is connected to the base layer by connecting fibers. Thereafter, there is applied to the top layer a polymeric finish having a smooth surface. Thus, the needled top layer of fibers is dense and smooth and is loosely-connected to the base layer by the connecting fibers.

A layer of non-participating fibers, which are not substantially engaged by the barbs of the needles in the second needling, may be laid on the needled base layer and the layer of high needle pick-up factor fibers is laid on the layer of non-participating fibers prior to the second needling. In one form of this process, the non-participating fibers are relatively coarse fibers which have large diameters as compared with the barb throat depth of the needles. In other forms of the process, the non-participating fibers are bonded fibers, bonded filaments, spun-bonded filaments, a paper membrane, non-textile fibers such as wood pulp, carrier threads and a woven or spun-bonded fabric. A part of the non-participating fibers may be removed subsequent to the second needling, e.g., by solvent extraction, and subsequently, a pressing and heating step may be performed to compress and permanently heat-set the normally oriented connecting fibers to form a crimped configuration thereof, which enhances said loose connection.

DETAILED DESCRIPTION OF THE INVENTION

Before describing in detail the present invention, an explanation of load-induced surface roughness in leathers is provided in order that the significance of the special structures of the present invention can be fully appreciated. However, it is specifically pointed out that the applicant herein is not bound by this theory but the theory is offered only by way of explanation.

As noted above, leather is fibrous in nature and composed of many bundles of fibers of varying size and density throughout the cross-section. Thus, it is not possible for an induced stress to be carried uniformly through this non-homogeneous material, a given overall strain will produce different local strains in the leather. For example, a uniform strain may produce a finite strain in a portion of the leather in an amount of X. However, due to the non-homogeneity of the leather, an adjacent portion may have a finite strain of only Y. The two portions of the leather, which originally had the same amount of surface area, now have different amounts of surface area. Unless there is a compensating structure in the leather, this non-homogeneity causes parts of those surface areas to either rise above or depress into the plane of the leather, resulting in a roughness or "orange peel."

The major amount of load applied to leather is carried by the base portion, with relatively small amounts of the load being carried by the "skin" portion. If uneven strain is produced in the base and is transmitted to the "skin", surface roughness, or "orange peel" will appear on the surface of the leather. As noted above, in calfskin, a plane of low modulus allows the "skin" to move relative to the base and the uneven strain in the base is not substantially transmitted to the "skin" surface. On the other hand, the uneven strain in the base of "split" leather, which has no plane of low modulus, is essentially transmitted to the surface and correspondingly surface roughness of the "split" leather may be observed.

The same cause-and-effects which produce surface roughness in leather may cause corresponding surface roughness in conventional artificial leather, since these usually have a fibrous substrate and a film portion. According to the present invention, a plane or region of low modulus and/or density is provided by special techniques. This low modulus/low density plane functions in a manner similar to the plane of low modulus/low density of calfkskin, as discussed above. Basic to the invention is providing connecting fibers between a top layer and base layer of the artificial leather fabric wherein the connecting fibers have segments disposed in each of the regions. By virture of the material of composition, number of fibers, configuration or degree of anchoring of the connecting fibers, the top layer is loosely connected to the base layer to provide the region of low modulus/low density.

The invention can best be understood by reference to the drawings where FIG. 1 diagrammatically shows a total process for making a preferred form of an artificial leather fabric according to the parent application. For conciseness, the details of the entire process are not repeated herein and the entire disclosure of the parent application is incorporated herein by reference and relied upon for its disclosure. According to that process, a plurality of layers of fibers is superimposed on one another by carding to form a web of loosely matted fibers having an increasing needle pick-up gradient in the Z direction, i.e., from the back surface to the face surface. The web is needled into an integral structure of cohering entangled fibers, wherein the needled structure has an overall bulk density of at least 6 pounds per cubic foot and has an increasing bulk density in the Z direction with a ratio of the bulk density of the back surface to the face surface in the range of at least 1:2 to as high as 1:8, preferably 1:3 to 1:5, and the axis of flexure lies at least within 0.4, e.g., 0.3 and especially 0.2 or 0.1 of the distance from the face surface to the back surface. The needle pick-up gradient and thus the resulting bulk density gradient is preferably accomplished by positioning the plurality of superimposed layers of fibers so that the average fiber denier decreases from the back surface to the face surface and/or is accomplished by positioning the plurality of superimposed layers of fibers so that the average fiber length of the layers decrease from the back surface to the face surface. Onto the face surface of this first so-needled fabric is laid one or more layers of relatively short, loosely-matted fibers. (The layers may also have denier and/or length variations.) Those layers are needled into the web to produce an overall bulk density of at least 8 pounds per cubic foot. The needled fabric is thereafter wetted with a needling fluid and (e.g., aqueous solution of a wetting and/or thickening agent) and then further needled while wet to increase the bulk density to at least 12 pounds per cubic foot.

After washing and drying, the needled structure is mechanically relaxed by passing the needled fabric through the nip formed by a wire (e.g., card wire) carrying roll and a friction (e.g., grit impregnated rubber) roll with the rolls having different peripheral speeds to adjust the modulus of the needled fabric in at least the machine direction. The fabric is then densified by shrinking the fibers at least at, and/or adjacent to, the face surface in a belt press with a heated top and cooled bottom belt. At least part of the fibers at, and/or adjacent to, the face surface are, therefore, at least in part, shrinkable thermoplastic fibers.

The needled and shrunk fabric is preferably impregnated with a filler, e.g., an elastomer, by a pad and nip to an add-on of the dried and cured impregnant of between 5% and 200% of the weight of the fabric to raise the bulk density. After setting the filler, e.g., by steaming, the filler impregnated fabric is dried. Thereafter the fabric may be buffed or sanded on the face surface and conventional leather finishes or artificial leather fabric coatings are applied to the face surface, followed by embossing to a desired surface appearance, e.g., grained.

The present invention is concerned, mainly, with the first and second needling operations (and, to some extent, the third) in order to provide a needled structure which will provide improved properties to the finished product. Otherwise, the process of the parent application, and to the breadth described therein, may be practiced with the present invention.

For purposes of this specification, the term "needle pick-up factor" is defined in the manner of the parent application wherein the needle pick-up factor was used to produce a needle pick-up gradient for building a corresponding bulb density gradient. Thus, "needle pick-up factor" refers to fiber characteristics and/or needle characteristics which influence the ability of the fibers to be picked up by the barbs of a needle and needled into an entangled structure. While needle penetration, barb depth, barb spacing and barb shape influence this ability of the fibers and the needle pick-up factor, the needle pick-up factor is preferably provided by fiber characteristics, such as differential fiber friction, fiber stiffness (modulus), fiber geometry, fiber surface, etc. For a detailed explanation of needle pick-up factor and resulting gradients, see U.S. Pat. No. 3,206,351, which patent is incorporated herein by reference. The preferred fiber characteristic to provide the desired needle pick-up factor is fiber geometry, e.g., fiber denier and/or length.

In the broadest form of the present process, a base of textile fibers is prepared by carding layers of relatively low needle pick-up factor fibers into a web of fibers. This web of fibers is pre-compacted by a conventional compacting roller and fed by a conveyor to a firstneedling zone where the web is needled into a base having a dense outer top surface. Onto the top of the dense outer surface is carded at least one layer of relatively high needle pick-up factor fibers. The so-produced composite is then needled in a second needling zone and the high pick-up factor fibers, e.g., relatively fine and/or short fibers, are needled on and into the dense outer surface. Thereafter, the needled structure is coated and cured to form a polymeric finish with a smooth surface on the face surface of the needled structure.

Figure 2:
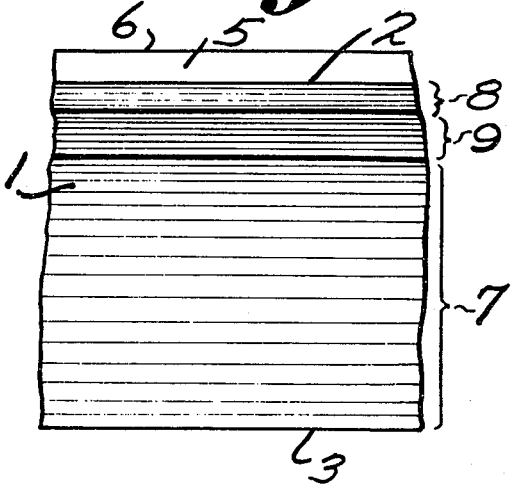
FIG. 2 is a diagramatic illustration of a cross section of the present fabric showing modulus and density variations therethrough.
Figure 3:
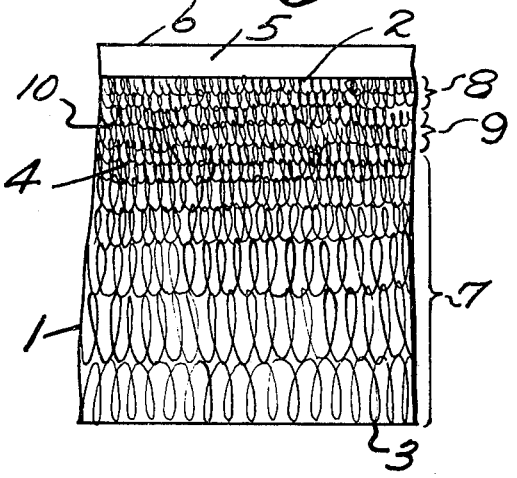
FIG. 3 is a companion illustration to FIG. 2 but shows the fiber entanglement corresponding to the modulus and density variations.

FIGS. 2 and 3, which are diagramatic crosssections, illustrate the needled structure which results. The intensity of the shading lines in FIG. 2 indicate the density of the various regions of needled fibers. The needled structure, generally 1, has a face surface 2, and a back surface 3. Between these surfaces lie a multitude of coherently entangled textile fibers 4. Disposed on the face surface is a polymeric finish 5 having a smooth surface 6. A base layer 7 of the needled structure extends from the back surface 3 towards the face surface 2 and lies generally parallel to the back surface. The base layer is adapted to carry the major proportion of a planar loading. A top layer 8 of the needled structure extends from the face surface 2 towards the back surface 3 and lies generally parallel to the face surface. The top layer is adapted to carry only a minor proportion of a planar loading. Base layer 7 and top layer 8 are connected by a connecting region 9. This connecting region has a plurality of connecting fibers 10 (see FIG. 3) of which fiber segments are disposed in each of the top layer, base layer and connecting regions. The top layer is loosely connected to the base layer by virtue of the nature of the connecting region. This loose connection prevents uneven stresses (and resulting strains) produced in the base layer by planar loading from being transmitted to the face surface.

In the present specification the term "planar loading" is defined to mean the tensile, shear and/or compressive stresses induced by strain in the plane of the needled fabric. Strains, i.e., dimensional changes of the fabric in the planar direction, are caused by the lasting or other forming of the artificial leather fabric. The dimensional changes may or may not be accompanied by overall planar area increases. In this regard, the plane of the fabric is defined as the perpendicular direction to the thickness dimension of the fabric at any point. Thus, a flat sheet of the fabric would have the plane of the fabric parallel to all parts of the surface. On the other hand, when the fabric is formed into a shoe, the fabric will have a multiplicity of planes, e.g., in the vamp portion and over the toe of the shoe, each being perpendicular to the thickness of the fabric at any point, and thus forming a complex surface.

For purposes of the present specification, the term "major proportion of the planar loading" means that such proportion is at least 60% and preferably at least 75% of the total planar loading. Conversely, the term "minor proportion of the planar loading" means that such proportion is no more than 40% and preferably no more than 25% of the total planar loading.

Figure 4:
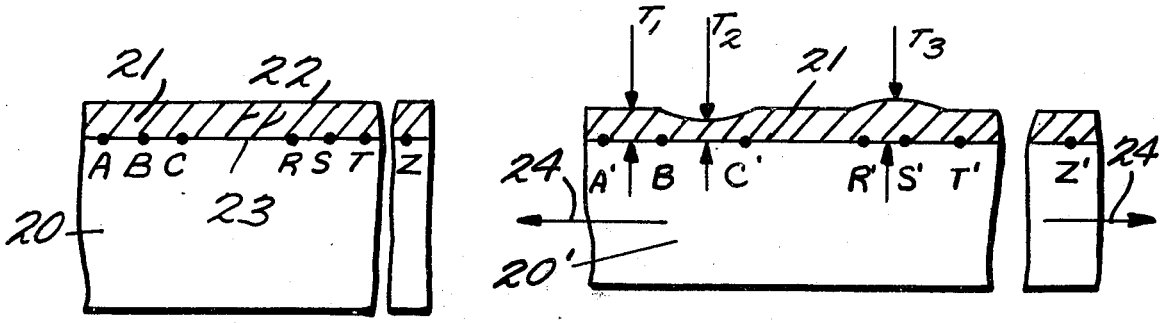
FIG. 4 is an idealized illustration of theoretical mechanism operating in the prior art and present fabrics.
Figure 4:
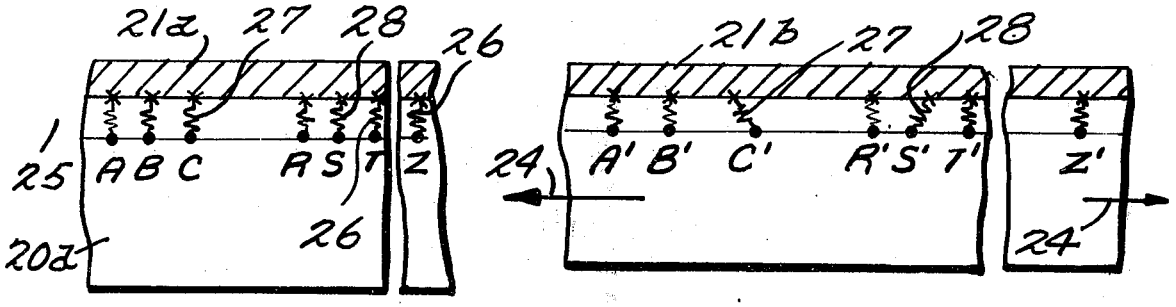

FIG. 4 shows the effects of an uneven strain in prior art artificial leather and in the present artificial leather fabrics. This figure is highly idealized to illustrate the principles involved. In the Figure, the needled fibrous substrate 20 of the prior art material is relatively rigidly attached to a polymer coating 21. Since the coating is a homogeneous material, the top surface 22 of the coating reflects the strains in the under-surface 23. If forces (indicated by arrows 24) act on fibrous substrate 20 to elongate the fibrous substrate to 20', the distances between points A and Z increase to the distance between points A' and Z'. When the fibrous substrate 20 is a relatively homogeneous material, then distances between succeeding equidistant points A/B, B/C, etc. will extend in substrate 20' to greater distances but remain equidistant, i.e., distances will remain proportional. However, needled structures are not homogeneous materials and local strains which make up a given overall strain may vary considerably, especially when the overall strain is about 5 to 8% or more. Thus, when the needled fibrous substrate has a localized portion which elongates a greater amount under the same overall stress, then the strain induced in fibrous substrate 20' may be B'/C', i.e., a proportionally greater elongation than the overall strain induced in the fibrous substrate. However, since the coating is a homogeneous polymeric material, the strain induced in the portion thereof which corresponds to B'/C' tends to be proportional to the overall strain induced in the fibrous substrate, i.e., less than the distance B'/C'. Since the fibrous substrate 20' is rigidly attached to the coating 21', the coating average thickness $T_1$ is reduced between B'/C' to the lesser thickness $T_2$ so that the total volume of coating between B'/C' is the same as between B/C. In other words, since the distance B'/C' is greater than the distance A'/B', $T_2$ must be less than $T_1$, i.e., the volume A' /B' x $T_1$ equals the volume B'/C' x $T_2$. Thus, a depression at $T_2$ is formed.

On the other hand, when there is a portion of high modulus, R/S, then the overall stress elongated 20 to 20' will produce a corresponding strain of only R'/S', i.e., less than A'/B'. Since the volume R'/S' x $T_3$ equals the volume A'/B' x $T_1$, then $T_3$ is greater than $T_1$ and a "hill" results. Thus, orange peel is due to variations in local strains as fibers in the needled structure adjust to share the tension load caused by stretching.

In the present materials, the fabric **20*a* is connected to the finish 21*a* through a low modulus plane 25. It should be understood that the connection of the finish 21*a* to fabric 20*a* is actually through top layer 8 (see FIGS. 2 and 3) but for sake of simplicity in this diagramatic illustration, top layer 8 has been omitted from the drawings of FIG. 4 "Present Fabric." Low modulus plane 25 is made up of connecting fibers 26 which, by virtue of the material composition, number of fibers, structural configuration or degree of anchoring, act as extensible, low-modulus fibers and which are shown in the drawing in a spiral or "spring" configuration. Thus, the greater strain B'/C' only causes an elongation of the associated connecting fibers 27 and does not cause a different volume in the finish 21***b* between B′/C′. Similarly, the lower strain portion R′/S′ only causes an elongation of the associated connecting fibers 28 and does not cause a different volume in the finish 21*b* between R′/S′. Thus, orange peel is avoided or substantially mitigated by such action of the fibers and this action is to be understood by reference to "loose connection" between the base layer and top layer (and finish).

The relatively low modulus connecting region may be provided by several different means. In a preferred form of the invention, the low modulus connecting region may be provided simply by constructing the overall needled structure (i.e., base layer, connecting region and top layer) so that the bulk density of the connecting region is less than the bulk density of either the top layer or the base layer. Thus, with the lower bulk density, the corresponding modulus in the low modulus-connecting region will be less than the modulus of either the base layer or the top layer.

The low modulus-connecting region may be provided by forming a web of loosely-matted low-needle pick-up factor textile fibers and needling this web to produce a needled base layer having a dense outer top surface. Onto this dense outer top surface of the base layer is carded at least one layer of high needle pick-up factor fibers and a second neelding of this layer of fibers on and into the dense outer surface of the base layer is performed. This produces a top layer that is loosely connected to the base layer by connecting fibers from the carded layer of high needle pick-up factor fibers. The "low needle pick-up factor" and "high needle pick-up factor" may differ as little as 15%, as explained more fully hereinafter.

In a preferred form of the invention, the low modulus-connecting region may be provided by carding onto the needled base layer a first layer of staple fibers having a first needle pick-up factor. Onto this first layer is carded a second layer of stapled fibers having a second needle pick-up factor which factor is greater than the needle pick-up factor of the fibers of the first layer. In this case, during needling, the barbs of the needle will preferentially pick up the fibers of the second layer and produce a relatively dense surface on the fully-needled fibers. Thus, this second layer of fibers forms the top layer of fibers. The fibers of the first layer are less aggresively picked up by the barbs of the needles and, therefore, the first layer is not needled on and into the base layer to the extent of the second layer. Additionally, the fibers of the second layer will be preferentially driven through the first layer and be anchored into the base layer. This greater needle pick-up factor of the fibers of the second layer will, therefore, provide a more dense top layer and the lower needle pick-up factor of the first layer will form a less dense and loosely-connected layer, when both layers are needled onto the base layer. The "high needle pick-up factor" layer may actually be composed of more than one layer of different needle pick-up factors, as described above, to enhance the magnitude of differences in modulus and the specifications and claims are to be so understood.

The different needle pick-up factors discussed above may be provided by differences in average denier of the fibers. The greater deniers provide a greater stiffness of the fibers and decrease the ability of the barbs of the needles to pick up and move the fibers. Thus, the higher deniers give a lower needle pick-up factor than the finer deniers.

The needle pick-up factor may also be provided by differences in the average length of the fibers. Longer fibers are more difficult to needle than short fibers, due to the additional inter-fiber friction of longer fibers and the increased difficulity for the barbs of the needles to move longer fibers without the fibers breaking or being dislodged from the barbs of the needles.

The needle pick-up factor may be provided by fibers of different inherent modulus. Thus, the lower modulus fibers are easier to needle and provide a greater needle pick-up factor. The difference in modulus of the fibers may be provided by a different chemical makeup of the fiber or by differences in molecular orientation of fibers of the same chemical makeup (drawing of the fibers). Thus, as is well known in the art, the modulus of a fiber is changed by additional drawing of the fiber in the drawing process.

The needle pick-up factor of fibers forming a web is directly reflected by the overall bulk density obtained by a given needling of that web. Thus, for example, a first web of fibers with a higher average needle pick-up factor than a second web of fibers will produce, under the same needling conditions, a needled web of correspondingly greater overall bulk density.

For example, as noted above, a needle pick-up factor difference as little as 15% may be used. The needle pick-up factor may be conveniently estimated by the relative densities obtained by needling comparative webs of fibers, with different needle pick-up factors, under the essentially same needling conditions. Such densities are conveniently measured by the method of ASTM test D-461-67 (See applicant's U.S. application Ser. No. 403,058, filed on Oct. 3, 1973).

In a preferred form of the invention, the needled structure has a bulk density gradient which increases from the back surface to the face surface. The bulk density gradient provides an axis of flexure which lies within about 0.4, e.g., 0.3, of the distance from the face surface to the back surface. The bulk density gradient of the needled structure may be provided by differences in the needle pick-up factor of the fibers used to construct the needled structure. Thus, as shown in FIG. 1, by carding a plurality of layers of fibers with each layer having a different needle pick-up factor, e.g., denier and/or length, the resulting needled fabric will have a bulk density gradient corresponding to the needle pick-up gradient, for the same reasons explained above. The needle pick-up gradient, and hence, the bulk density gradient, decreases from the back surface to the face surface. The denier of the fibers may be between about ¾ and 8, and the staple fibers may have lengths between ¼ inch and 4 inches.

In regard to the needling technique, it is also preferred that the coherent fiber entanglement of the base fabric include some of the fibers being oriented into closely spaced rows of fiber chain entanglement, the rows extending lengthwise of the structure. It should be understood that fiber chain entanglement is a specific type of needling which produces an exceptionally strong needled product and which term has an accepted meaning in the art. Generally, fiber chain entanglement is characterized by a large degree of fiber curvature, over-and-under orientation, interlooping and Z-direction chaining. A complete explanation and definition of fiber chain entanglement and a complete description of the fiber chain entanglement producing looms are disclosed in U.S. Pat. Nos. 3,112,552; 3,090,099; 3,090,100; 3,112,549; 3,112,548 and 3,132,406, which disclosures are incorporated herein by reference. Fiber chain entanglement needling is referred to in the art by way of the trademark FIBERWOVEN of FIBERWOVEN LOOMS, and for convenience in this specification, that terminology will be used herein.

The overall bulk density in the needled structure (i.e., as needled) is preferably at least 6 pounds, especially at least 8 pounds per cubic foot and more preferably at least 10 to 12 pounds per cubic foot. However, densities in excess of these densities may readily be achieved, i.e., densities of 13 or 14 pounds or greater, especially 16 to 18 pounds or even up to 20 to 22 pounds per cubic foot.

As noted above, a basic feature of the invention is the providing of a connecting region between the top layer and the base layer of the needled structure whereby the top layer is only loosely connected to the base layer. The term "loosely connected" in the above regards is herein defined as the functional result of providing for relatively independent movement of the top layer and the base layer in the manner that the corium and grain regions of leather have the ability for relatively independent movement. Thus, the connecting region may be of a low modulus, soft or spongy nature, in the manner of the junction of the corium and grain of leather after removal of the sweat glands, fat cells and hair folicles from the skins or hides, and, correspondingly, the modulus in the connecting region is less than the modulus of either the top layer or base layer.

In addition to the methods noted above, this low modulus region may be provided by a lower density, e.g., structural configuration, in the connecting region, when the layers are made of the same material, or by the use of a different lower modulus material in the connecting region, or both. The lower density in the connecting region may be provided in a structure of only needled fibers of the same material by using a smaller number of needled fibers per unit volume in the connecting region than in either the top or base layers. The modulus is primarily, however, effected by the geometry of the connecting fibers, e.g., springs, coils, crimps and angles of the connecting fibers.

The connecting region can, however, be quite thin and be more of a manner of connecting the top layer and the base layer than a visually-identifiable region. Thus, the material composition of the fibers (e.g., effecting the elasticity thereof), the number of fibers (e.g., effecting an overall lower density and, thus, modulus of the connecting region), the configuration of the fibers (e.g., springs, coils, etc.) and the degree of anchoring of fibers in the top and base layers (e.g., tight, loose) may provide the low-modulus connecting region and the loose connection. In each of the foregoing, however, it is the nature of the connecting fibers which is controlling.

It should be understood in the above regard that the term "connecting fibers" has primary reference to those fibers which are predominantly disposed in the normal direction, i.e., the thickness direction. As noted above, the connecting region may be quite small in the normal direction and be very close to only a plane between the top layer and the base layer. In this connecting region, there is a discontinuity in fiber entanglement and the connecting fibers are predominantly arranged in the normal direction of virtue of the effect produced by the subsequent needling of an added layer(s) of fibers on and into the base layer. For example, where a dense outer surface has been prepared by the needling of the base layer, a "barrier" is presented which will allow fibers firmly engaged by the barbs of the needles to pass therethrough but will substantially prevent passage of fibers which are only secondarily associated with the fibers engaged by the barbs of the needles. Accordingly, this substantial prevention of movement of secondarily-associated fibers through the barrier results in an entanglement discontinuity and a connecting region characterized by the presence of normally-disposed fibers so oriented by being firmly engaged by the barbs of the needles.

This "barrier" effect can also be produced by providing a layer of non-participating fibers between the base layer and the layer of fibers which will form the top region. Non-participating fibers are fibers which have a needle pick-up factor such that the barbs of the needles are not capable of substantially engaging the non-participating fibers. The non-participating fibers thus form a barrier to needling in the nature of the dense outer top surface of the needled base layer. The non-participating fibers may be of a non-textile fiber, e.g., wood pulp, which is not substantially susceptible to needling, or of textile fibers which by reason of the material modulus or large diameters (coarse fibers) or long staple lengths do not substantially participate in the needling.

The term "coarse" fibers, which do not participate in the needling operation, has reference to the diameter of those fibers as compared with the barb throat depth of the needles used in the needling operations. In order for those coarse fibers to not significantly participate in the needling operations, the fiber diameters should be large compared with the barb throat depth of the needles, i.e., the barb throat depth preferably should be no more than at least 5 times the diameter of the fibers and, preferably, the barb throat depth should be no greater than 3 times the diameter of the coarse fibers. Thus, in the present specification and claims, the term "non-participating" coarse fibers has the foregoing definition. Also, staple fibers may have lengths such that the inter-fiber frictional force is greater than the force which can be generated on the fibers by the barbs of the needles, i.e., lengths between 3 and 7 inches. In this case, the fibers simply slip out of the barbs of the needles during needling and, thus, are also non-participating fibers. In the present specification and claims, the term "non-participating" fibers is intended to include both of these kinds of non-participating fibers. Conversely, of course, fibers with characteristics of needle pick-up factor greater than the foregoing will substantially participate in the needling and are referred to as "participating" fibers herein.

A significant improvement in the properties of artificial leather fabric can be provided by a needled fabric of relatively high density, with or without the overall bulk density gradient or displacement of the axis of flexure, as discussed above. However, these latter properties do enhance the usefulness of the artificial leather fabric and, therefore, in the preferred process, provisions are made to obtain these properties. Thus, in a preferred embodiment of the process, a plurality of layers of fibers are superimposed on one another, e.g., by carding, to form a web of loosely matted fibers having a needle pick-up factor gradient which increases in the Z direction, i.e., from the back surface to the face surface. The overall web of fibers is characterized by fibers of relatively low needle pick-up factor i.e., relatively long and/or coarse fibers. The web is needled into an integral structure of coherent fiber entanglement, wherein the needled structure has an overall bulk density of at least 6 pounds per cubic foot and has an increasing bulk density in the Z direction with a ratio of the bulk density of the back surface to the face surface in the range of at least 1:2 to as high as 1:8, preferably 1:3 to 1:5 and an axis of flexure which lies at least between 0.4, e.g., 0.3 and especially 0.2 or 0.1 of the distance from the face surface to the back surface. The needle pick-up factor gradient and thus the resulting bulk density gradient may be accomplished by providing that the average fiber denier and/or fiber length decreases from the back surface to the face surface. After this web is first needled into the integral structure, at least one layer of staple fibers is laid on the dense outer top surface of the needled structure, e.g., by carding. Suitably, two layers of the staple fibers are placed on the top surface of the needled structure, as discussed above. However, it should be noted that the resulting top layer and connecting layer may be provided by more than two layers of fibers. For example, the top layer could be composed of layers of fibers of different denier, length, modulus, etc., and the layer from which the connecting fibers are needled could likewise be composed of a plurality of layers. The only critical consideration is that the needle pick-up factor, as discussed above, be preserved in the overall combination.

For example, a first layer carded on the dense outer top surface of the first needled structure may have a higher denier and/or length than a second layer. Thereafter, a layer of fine and/or short fibers may be carded onto the second layer. The barbs of the needles in the second needling operation engage the short and/or fine fibers and needle these fibers on and into the dense outer top surface of the needled structure. By continuing the further needling by about at least 2000 needle punches per square inch, especially 4000 and up to 6000 or 7000 punches per square inch, the resulting needled fabric will inherently have a top layer of fine fibers which is dense and smooth and is loosely connected to the base layer, as described above.

The fabric produced according to the present invention is quite suitable for use in the production of artificial leather and like materials. In view of the structure of the fabric, especially in regard to the character and position of low modulus layer, the present product can be extended above about 9% on an area basis without significant transmittal of load-induced distortions from the base layer to the top layer. Particularly, the present product can be extended at least 10% and usually at least 12% to 15% or even more on an area basis without any surface distortion of the foregoing nature. These proper-contraction as in older traditional methods where the leather was pulled across the toe and then across the vamp. The older method thus gave the material opportunity to make area modifications by other mechanisms and did not require as great an area extension as the modern methods.

It will also be apparent to those skilled in the art that the present low modulus layer may be in part provided by methods other than the needling techniques described above. For example, some of the fibers carded onto the base layer may be extractable fibers. After needling these fibers into the base layer, the extractable fibers can be extracted to leave a loose low modulus connecting region. The fibers may be extractable by solvent, e.g., water or inorganic or organic solvents and/or heat. Thus, polyvinyl alcohol fibers could be used as a portion of the first layer of fibers which are carded onto the base layer and those may be extracted by warm water after the needling has been completed. It should be understood that regardless of the method used to develop a density discontinuity in the needled fabric structure, e.g., by needling techniques or by use of fibers with different pick-up factors in successive layer or by use of a barrier or non-participating fiber layer or by removal of fibers through solution, the low modulus layer is enhanced by subsequent pressing to kink, or deform, the connecting fibers. A loose connection is effected by localized straightening of such kinked or distorted connecting fibers or by fiber slippage due to loose anchoring of the connecting fibers. Other means of providing the low modulus layer will be quite apparent to those skilled in the art and those further modifications of the present process to produce the present product are intended to be embraced by the present disclosure and the following claims.

The particular composition of the fiber is not critical to the invention, and various combinations of fibers may be used. These combinations may include natural fibers of plant or animal origin such as cotton, collagen and wool, and synthetic fibers such as nylon, acrylics, cellulosics, olefins, e.g., polyethlene, polypropylene, polyvinyl chloride, polyvinyl acetate/polyvinyl alcohol, polyvinyl chloride/polyvinyl vinylidene and polyester. The preferred fibers, however, are commercial nylon, viscose and/or polyester fibers, since these fibers provide excellent workability in the process and have inherent chemical properties which resist degradation due to perspiration and the like.

The needle fabric has most of the desired physical properties for use as an artificial leather fabric (except for the finish), but in order to provide a hand and feel and even greater density, the fabric is preferably impregnated with a filler, although the use of a filler is not required. The filler may be any inert solid, either organic or inorganic, which contributes to the overall bulk density of the structure, e.g., finely divided inorganic fillers such as bentonite, chalk, kaolin, talc, clays, asbestos, diatomaceous earth, silica flour, mica, magnesium silicate, zeolites, carbon black, zinc oxide, barytes, ferric oxide and the like. Preferably, the inorganic fillers are loosely bonded to the fibers of the structure with an adhesive, especially an elastomeric adhesive such as plasticized polyvinyl chloride, natural rubber, butadiene rubbers, polychloroprene rubbers, polyurethane rubbers, silicon rubbers, etc. Also, the filler may be an organic material such as a natural polymer, e.g., collagen or a synthetic polymer or copolymer such as acrylonitrile polymers, silicone rubbers, chlorosulfonated polyethylene, polyethylene and polypropylene, plasticized polyvinyl chloride, Kel-F type copolymers of tetraflurorethylene and chlorotrifluoroethylene, fluorosilicone rubbers such as Silastic LS 35, poly(alkylene oxide) polymers and natural rubber of any of the conventional leather fillers.

Natural rubber is a preferred filler. Natural rubber is vulcanized for use as the present filler and any of the conventional vulcanizing agents may be used such as sulfur compounds, peroxides, diazoaminobenzenes, tetraalkylthiuram disulfides, bisthiol acids and salts, quinones, imines, oximes, anilines, thiazides and phenols. The vulcanizing may be in the presence of oxidizing agents. Conventional accelerators such as thiazoles, dithiocarbamates, aldehydeamines and quanidines may be used in vulcanizing the natural rubber, along with conventional antioxidants and other conventional compounding ingredients (see Fisher, Harry L., Chemistry of Natural and Synthetic Rubbers, Reinhold Pub. Corp., N.Y. 1957).

The method of impregnating the filler can be as desired, but it is preferred to simply impregnate the fabric by padding to the correct add-ons with a pad and nip. This method is especially convenient when the latex, e.g., natural latex, is used as the filler elastomer. Thereafter the elastomer latex is precipiated or coagulated. Any conventional means of coagulation may be used, but it is preferred to coagulate the latex with steam, e.g., of up to about 6°F superheat.

Thereafter, the latex impregnated fabric is cured and/or dried. The curing and/or drying temperatures will be those consistent with the particular latex being used, all of which is well known in the art. However, for example, temperatures for natural latex between 200°F and 300°F and times between 10 minutes and 30 minutes are satisfactory. Curing may be accomplished with the live steam coagulation step.

After the needled fabric has been impregnated with a filler and cured, the finish may be applied. The particular finish material is not critical to the invention and may be as desired. Conveniently, conventional leather or artificial leather finishes are applied and in the same manners known to those arts. Thus, the finish may be one or more coatings of one or more polymeric film-forming materials, either natural or synthetic, e.g., plasticized varnishes, unsaturated air curing oils and lacquers, or polyacrylics, polyacrylates, polyvinyl chloride and copolymers thereof, polyurethane, polyimides, polyesters, polyamides and polyolefins.

The finish may be applied in any desired manner, e.g., spraying, kiss-coating, roll-coating, rodding or doctoring. Conveniently, a thin flexible doctor blade (e.g., hard rubber or thin, spring steel) is used. The manner of applying the finish is not critical and it can be applied according to any of the known methods of the coating arts. Coating techniques and compositions useful with the present invention are described in detail in U.S. Pat. Nos. 3,000,757; 3,067,482; 3,100,721; 3,190,766; 3,208,875; 3,284,274 and 3,483,015, the entire disclosures of which are incorporated herein by reference. Alternately, previously-prepared films of the film-forming polymeric materials may be laminated to the needled fabric, see, for example, U.S. Pat. No. 3,325,388 for details of preparation of a suitable polyurethane film.

The amount of finish applied can be as desired, e.g., up to 20 mils thick or more. However, the finish will more generally be less than 15 mils, e.g., 12 mils or less. The finish can be quite thin, in the manner described in the parent application, e.g., less than 3 or 4 mils and even as little as 1 mil.

After application of the finish, the fabric is ready for embossing. For example, the surface may be embossed to that resembling a fine-grained calfskin, a reptile leather, a crushed grain type finish, or an ornamental design, if desired. Any conventional leather or artificial leather embossing press may be used, and the platens of the press will have a pattern therein consistent with the pattern desired. The embossing temperatures, pressures and times are not critical and it is only necessary that sufficient conditions be used to accomplish an embossing on the surface to the depth desired. For example, with conventional acrylic leather finishes, embossing pressures of about 25 pounds per square inch up to about 500 pounds per square inch may be used, with temperatures between 150°F and 400°F. Within this range of temperature and pressure, times of as little as 10 seconds may be used, but it is preferred that longer times, e.g., 20 seconds up to three minutes, be used in order to fully emboss the desired design on the fabric. Of course, the product is cooled after embossing. After the embossing operation, the product is cut to desired lengths and is ready for fabrication into shoe uppers and like artificial leather goods.

The invention will be illustrated by the following examples, but the invention is not limited thereto, but extends to the foregoing disclosure.

EXAMPLE 1

Onto a conveyor was carded a first layer of polyester staple fibers, Type HT, High-crimp, 1½ denier and 1½-½ inch length. A second layer of staple polyester fibers was carded on the first layer. This layer was a blend of fibers having deniers between 2 and 5 and lengths between 1½ and 3 inches, with an average denier of 3 and an average length of 2½ inches. Two lightly bonded, light-weight, polyester non-woven webs were placed on top of the second layer of fibers. On top of these non-woven webs was carded a third layer of fibers which was identical to the second layer of fibers and on top of the third layer of fibers was carded a fourth layer of fibers which was identical to the first layer of fibers.

The two composites were passed to a first needling station of a FIBERWOVEN loom with Foster 1-16-4C (1 barb-16 mil triangular blade-4 mil barb depth) needles. In this first needling operation, each needle penetrated each mirror image of the webs of the composite 8 times per linear inch and each composite had, therefore, 1330 needle penetrations per square inch. This first needling consolidated the web into a batt with substantial integrity.

After the first needling operation, the two needled mirror image composites were mechanically separated by pulling apart at the non-woven web, and after reversing the bottom composite, it proceeded through the process in the same manner as the top composite.

The composite was then needled in a second needling operation in a FIBERWOVEN loom having Foster 1-16-3C needles and the barbs of the needles of the bottom needle board penetrated just to the face surface of the composite. Each needle penetrated each side of the composite 12 times per linear inch which corresponds to 1540 needle penetrations per square inch for each side of the composite. The composite had a needled weight of about 8 oz. per square yard.

Onto the surface of the so-needled composite was carded a first layer of relatively short fibers in an amount of 3 ounces per square yard. The denier of the fibers was 1½ and the length was 1½ inches. The fibers were polyester staple fibers, Type HT, High-crimp. Thereafter, a second layer of fibers was carded on the first layer of carded fibers. The second layer was identical to the first layer except that the length of the fibers was even shorter, i.e., was ⅝ inch.

The composite with the carded fibers thereon was then needled in the FIBERWOVEN loom where the needles, the barb penetrations, the needle punches per inch per needle and the total needle penetrations per square inch were the same as in the previous needling step. Thus, there were 1540 needle penetrations for each side of the composite.

The needled fabric had a low modulus layer corresponding to the plane where additional fiber was added after the first needling. Along the plane the modulus was less than the modulus of either the resulting top layer or the base layer.

To provide an overall density for the needled fabric which is desirable for an artificial leather fabric, the so-needled composite was immersed in a bath of needling fluid (amine salt of coconut fatty acids, diluted to 6% solids with water) and further needled in a loom where the needles were the same as in the previous needling operation. The barbs of the top needle boards penetrated through the composite by ⅛ inch. There were 6658 needle punches per square inch on each side of the composite. The needled fabric was washed in clean water to remove the needling fluid and squeezed to remove the wash water. The fabric was heated with an open flame dried at temperatures less than 250°F.

During the needling operations described above, the composite was fed into the looms in a manner to minimize machine direction tension on the composite. This minimum tension also allowed the composite to wander or wobble slightly in the transverse direction while passing through the looms.

The out-of-balance modulus of the composite was corrected by passing the fabric through the nip formed by a roll carrying a grit-impregnated rubber surface operated at a peripheral surface speed 35% greater than a cooperating roll carrying a wool card wire surface. The fabric was passed in the machine direction through the nip between the rolls six times. The rolls of the machine were adjusted so that the outermost portion of the wires of the wire roll lightly touched the surface of the rubber roll.

The composite was heated from the face surface by a blast of air 500°F for approximately 4 to 5 seconds, with subsequent light sanding of the back face to even the thickness of the fabric, and immediately passed to a travelling belt press. The composite contacted the belt for about 6 seconds.

The fabric was impregnated with a natural rubber latex having 50% total solids and then squeezed lightly to produce a weight add-on of approximately 200%.

The latex was coagulated in the fabric by steam at 218°F for 10 minutes and cured during this steam treatment, after which it was dried at temperatures less than 250°F.

The face surface was buffed with sand paper to remove up to about 5 mils from the face surface and a urethane tie coat was applied to the face surface of the fabric with a thin flexible steel doctor blade having a pressure of 2½ pounds per linear inch thereof. The urethane tie coat was a prepolymer of polytetramethyleneether glycol and tolylene-2,4-diisocyanate, phenyl diisocyanate and trichloroethylene. The fabric with the tie coating thereon was dried under infrared lamps. The fabric was then allowed to lag at room temperature for about 3 hours.

The fabric with the tie coat thereon was then passed through a heated belt press to accomplish the perpendicular mechanical pressure with a part of the belt heated to 400°F. The belt press exerted a pressure of approximately 20 pounds per square inch.

The base color coat was sprayed onto the pressed tie coat. The base color coat was composed of primal Ochre (15 parts), primal White 264 (9 parts), primal Red (1 part), water (38.5 parts), 74/20/3/3 copolymer of ethyl acrylate, methyl acrylate, methylol acrylamide and methacrylic acid (36.6 parts). The base color coat was then dried at less than 200°F.

The fabric was then embossed at 345°F for 15 seconds using a Sheridan Batch Press with a pressure of about 500 pounds per square inch.

A top finish coat was then sprayed on the fabric and dried under infrared heaters at less than 200°F. The top finish coat was nitrocellulose lacquer (50 parts), methyl ethyl ketone (15 parts), dissobutyl ketone (30 parts) and carbon black (5 parts). The fabric was then fully cured at 330°F for 2 minutes in a tunnel drier.

The fabric was mechanically softened by boarding in a conventional leather boarding machine with the face surface contacting the rolls of the boarding machine.

The resulting product was supple, having the feel, grainy appearance, color and texture of leather. The density of the material was approximately 35 pounds per cubic foot. The bending break had 18 wrinkles per inch indicating the flex axis very near the face surface. The bulk density gradient from the back surface to the face surface was approximately 1:2.5.

The finished artificial leather could be stretched in a lasting machine, where the material was grasped at all sides, until the elongation of the material reached 9% on area basis without furface distortions in the base layer being substantially transmitted to the surface layer.

EXAMPLE 2

Example 1 was repeated except in regard to the needling operations which varied as follows. After the mirror image composites of the first needling operation were separated, the separated composite was needled with about 5000 needle penetrations per square inch (as opposed to 1540 for Example 1) on each side (about 10,000 on both sides) to effect a greater surface barrier, as discussed hereinbefore. The two layers of short fibers were then carded on the surface and needled with about 3000 needle penetrations per square inch on each side (6000 both sides) instead of the 1540 of Example 1. The further third needling of Example 1 with the needling fluid was eliminated.

Thus, the total needling (both sides in Example 1) was about 22,000 needle penetrations per square inch while in this example, there were about 18,6000 needle penetrations per square inch. However, a tighter barrier was needled in the second needling step to intensify the plane of low modulus produced by allowing less fiber anchoring of the surface layer.

The needled product of this example had a base which was more load bearing than Example 1 and the elongation without any surface roughness exceeded 14% whereas in Example 1 only about 9% elongation could be obtained without surface roughness. This reference is, however, to the first onset of surface roughness and in both cases, further elongation is permissible before resulting surface roughness becomes objectionably present.

What is claimed is:

1. An artificial leather fabric comprising:

1. A needled structure of coherently entangled textile fibers of at least 8 pounds per cubic foot overall bulk density and wherein the needled structure has a back surface and a face surface with a bulk density gradient which increases from the back surface to the face surface and provides an axis of flexure which lies within about 0.4 of the distance from the face surface to the back surface;

2. A polymeric finish having a smooth surface disposed on the face surface of the structure;
3. A base layer of the needled structure which extends from the back surface toward the face surface and lies generally parallel to the back surface and which base layer is adapted to carry the major proportion of a planar loading;
4. A top layer of the needled structure which extends from the face surface toward the back surface and lies generally parallel to the face surface and which top layer is adapted to carry only a minor proportion of a planar loading; and
5. The base layer and the top layer being connected by connecting fibers having segments disposed in each of the said layers, and said connecting fibers only loosely connect the top layer to the base layer.

2. The fabric of claim 1 wherein the connecting fibers form a connecting region between the top layer and the base layer and the modulus of the connecting region is less than the modulus of either the top layer or the base layer.

3. The fabric of claim 2 wherein the density of the connecting region is less than the density of the base layer or the top layer.

4. The fabric of claim 2 wherein the lower modulus of the connecting region, at least in part, results from at least one of the configuration of the connecting fibers, the material composition of the connecting fibers, the number of the connecting fibers in the connecting region and the mode of anchoring of the connecting fibers in the top and base layers.

5. The fabric of claim 4 wherein the modulus of the connecting region, at least in part, results from the configuration of the connecting fibers in the connecting region.

6. The fabric of claim 4 wherein the modulus of the connecting region, at least in part, results from the material composition of the connecting fibers in the connecting region.

7. The fabric of claim 4 wherein the modulus of the connecting region, at least in part, results from the number of connecting fibers in the connecting region.

8. The fabric of claim 4 wherein the modulus of the connecting region, at least in part, results from slippage of connecting fibers which are loosely anchored in both the top layer and base layer.

9. The fabric of claim 1 wherein the top layer is connected to the base layer by a plurality of connecting fibers, said connecting fibers being composed of top layer connecting fibers needled from the top layer into the base layer and base layer connecting fibers needled from the base layer such that the top layer is loosely connected to the base layer and the connecting fibers form a connecting region which has a modulus less than the modulus of either the top layer or the base layer.

10. The fabric of claim 9 wherein the connecting fibers are tightly anchored in both the top layer and base layer.

11. The fabric of claim 2 wherein the normal modulus in the connecting region is less than the normal modulus in either the top region or base region.

12. The fabric of claim 1 wherein the base layer has a density gradient.

13. The fabric of claim 12 wherein the density gradient increases from the back surface towards the face surface.

14. A process for producing the artificial leather fabric of claim 1 comprising:

1. forming a web of loosely-matted, low-needle pick-up factor textile fibers;
2. first needling the web to produce a needled base layer having a dense outer top surface;
3. laying on the said dense outer top surface a layer of high needle pick-up factor textile fibers;
4. second needling the high needle pick-up factor fibers on and into the said dense outer top surface until a top layer with a face surface of the high pick-up factor fibers is formed and the top layer is connected to the base layer having a back surface by connecting fibers and wherein the so-needled fabric has coherent fiber entanglement, an overall bulk density of at least 8 pounds per cubic foot and a bulk density gradient which increases from the back surface to the face surface and provides an axis of flexure which lies within about 0.4 of the distance from the face surface to the back surface; and
5. applying to the face surface of the top layer a polymeric finish having a smooth surface;

whereby the needled top layer of fibers is dense and smooth and is loosely-connected to the base layer by the connecting fibers.

15. The process of claim 14 wherein a layer of non-participating fibers which are not subsequently substantially engaged by the barbs of the needles in the second needling is laid on the needled base layer and the layer of high needle pick-up factor fibers is laid on the layer of non-participating fibers prior to the second needling.

16. The process of claim 15 wherein the non-participating fibers are in the form of relatively coarse fibers which have large diameters as compared with the barb throat depth of the needles.

17. The process of claim 15 wherein the non-participating fibers are in the form of bonded fibers.

18. The process of claim 15 wherein the non-participating fibers are in the form of bonded filaments.

19. The process of claim 15 wherein the non-participating fibers are in the form of spun-bonded filaments.

20. The process of claim 15 wherein the non-participating fibers are in the form of a paper membrane.

21. The process of claim 15 wherein the non-participating fibers are in the form of wood pulp.

22. The process of claim 15 wherein the non-participating fibers are in the form of a paper membrane.

23. The process of claim 15 wherein the non-participating fibers are in the form of a woven or spunbond fabric.

24. The process of claim 15 wherein at least part of the non-participating fibers are removed subsequent to the second needling.

25. The process of claim 24 wherein the non-participating fibers are removed by solvent extraction.

26. The process of claim 24 wherein, subsequent to removal of the non-participating fibers, a pressing and heating step is performed to compress and permanently heatset the normally oriented connecting fibers to form crimped configuration thereof which enhances said loose connection.

27. The process of claim 14 wherein the low needle pick-up factor fibers are relatively long and/or coarse fibers and the high needle pick-up factor fibers are fine and/or short fibers.

28. The process of claim 27 wherein the fine and/or short fibers are high crimped fibers.

29. The process of claim 28 wherein the crimped fibers are as spiral crimped.

30. The process of claim 14 wherein the high needle pick-up factor fibers are needled into the base layer at an angle perpendicular to the plane of the base layer.

31. The process of claim 14 wherein the second needling is followed by a pressing and heating step to compress and permanently heat-set the normally-oriented connecting fibers connecting the top layer and the base layer to form a crimped configuration thereof which produces the said loose connection.

32. The process of claim 14 wherein the connecting fibers connecting the base layer with the top layer have a heat-setting temperature less than the heat-setting temperature of the fiber of the base layer and the second needling is followed by a pressing and heating step to compress and permanently heat-set the connecting fibers to form a crimped configuration thereof which produces the said loose connection.

33. The process of claim 14 wherein the web of fibers forming the base layer has a layer of shrinkable fibers at the uppermost portion thereof and the first or second needling is followed by a shrinking step to cause the shrinkable fiber to shrink and produce a more dense region at the uppermost portion of the base layer whereby the modulus of the base layer is increased.

34. The process of claim 14 wherein a thin resinous coating is placed on the dense outer top surface of the base layer prior to laying on the high needle pick-up factor fibers.

35. The process of claim 14 wherein the polymeric finish substantially penetrates into the said top layer.

36. The process of claim 14 wherein the polymeric finish does not substantially penetrate into the said top layer.

37. The process of claim 14 wherein the polymeric finish is a discontinuous coating.

38. The process of claim 14 wherein the polymeric finish is a continuous coating.

39. A processs for producing the artificial leather fabric of claim 1 comprising:

1. forming a web of loosely-matted, relatively long and/or coarse textile fibers;
2. laying on the web a layer of loosely-matted, non-participating fibers;
3. laying on the non-participating fibers a layer of relatively fine and/or short textile fibers to form a composite;
4. needling the composite with needles such that the barbs of the needles do not substantially engage the non-participating fibers, continuing the needlng until a base layer with a back surface is formed from its web and a top layer with a face surface is formed from the fine and/or short fibers and the top layer is connected to the base layer by connecting fibers from the layer of fine and/or short fibers, and wherein the so-needled fabric has coherent fiber entanglement, an overall bulk density of at least 8 pounds per cubic foot and a bulk density gradient which increases from the back surface to the face surface and provides an axis of flexure which lies within about 0.4 of the distance from the face surface to the back surface; and
5. applying to the face surface of the top layer a polymeric finish having a smooth surface;

whereby the top layer is dense and smooth and is loosely connected to the base layer by the connecting fibers.

* * * * *